United States Patent [19]

Noly

[11] 4,350,254

[45] Sep. 21, 1982

[54] CONTAINER HANDLING AND LIFTING EQUIPMENT, SUCH AS A CRANE OR A GANTRY

[75] Inventor: Jean Noly, La Clayette, France

[73] Assignee: Potain, France

[21] Appl. No.: 104,304

[22] Filed: Dec. 17, 1979

[30] Foreign Application Priority Data

Dec. 15, 1978 [FR] France ..... 78 36063

[51] Int. Cl.[3] ..... B66C 13/16

[52] U.S. Cl. ..... 212/153; 212/242; 294/81 SF

[58] Field of Search ..... 212/153, 221, 242, 251, 212/259; 294/81 SF, 67 DA

[56] References Cited

U.S. PATENT DOCUMENTS

| | | | |
|---|---|---|---|
| 3,498,473 | 3/1970 | Spaulding et al. | 212/259 |
| 3,558,176 | 1/1971 | Fathauer et al. | 294/81 SF |
| 3,598,440 | 3/1969 | Ramsden | 294/81 SF |
| 3,675,960 | 7/1972 | Mangold | 294/81 SF |
| 3,828,940 | 8/1974 | Cooper | 294/81 SF |

FOREIGN PATENT DOCUMENTS

| | | | |
|---|---|---|---|
| 2277027 | 1/1976 | France | 212/153 |

*Primary Examiner*—Robert W. Saifer

*Attorney, Agent, or Firm*—Remy J. VanOphem

[57] ABSTRACT

A lifting apparatus includes two lifting hoists which are respectively associated with two cables. These cables are lowered in parallel with one another, and are connected to a fixed part of a rotating apparatus. The rotating part of this apparatus moves along longitudinal rails of a secondary frame which is attached to the carrier of the container. The lifting operation may be performed as the container's gravity center reaches the perpendicular axis of the center of a quadilateral defined by four points established by an electronic device which detects the various loads within the lifting cables and is adapted to actuate appropriate hydraulic means to maintain a load differential between the cables below a predetermined value. In this respect, the apparatus balances the containers to be lifted before lifting them.

15 Claims, 8 Drawing Figures

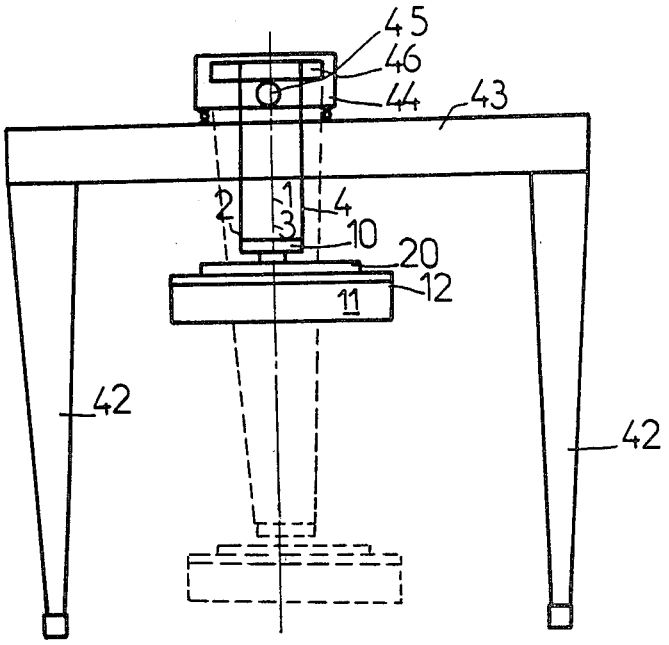
FIG 7
FIG 8
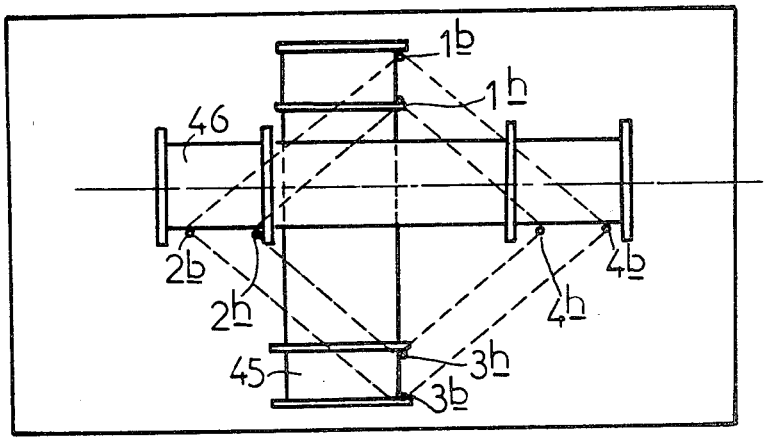

CONTAINER HANDLING AND LIFTING EQUIPMENT, SUCH AS A CRANE OR A GANTRY

FIELD OF THE INVENTION

The present invention pertains to a container handling apparatus, operated as special equipment which is independent from the type of machine used. This invention also pertains to secondary devices which are used to adapt this equipment to a crane, a gantry or any other lifting equipment. This invention applies particularly to the handling of containers which are held by reinforced corner fittings, using a spreader suspension system.

BACKGROUND OF THE INVENTION

The invented apparatus is designed to meet the requirements of the various container handling operations:

The container must be orientated in order to position it on a transportation vehicle, a boat or another carrier.

The overall dimensions of the container itself must be taken into consideration so as to make allowances for the bulk of the container.

The container should not be excessively tilted in the direction of its longitudinal axis. Excessive tilting, such as those resulting from a bad weight distribution in the container, could prevent the correct loading of the container inside a ship for instance.

Likewise, the axis of the hanging system should remain vertical throughout the container handling operations.

In order to solve the above problems, two types of equipment have been designed.

In the first type of equipment, the container orientation system hangs from the lifting cables and is directly connected to the spreader. This solution has the disadvantage of limiting the hanging pattern to a square in which the diagonal is equal to the width of the spreader, since its overall dimensions cannot exceed the container's dimensions regardless of its orientation. Obviously, the container will remain stable only as long as its center of gravity is located inside that square. This condition being met, the loading operation of the container is generally off-centered and the cables are subjected to various loads which increase the tilting of the container, due to cable elongation. It becomes increasingly difficult to compensate for the excessive tilting by taking up the length of the cables, as the cable loads and cable elongation vary with the container's orientation. Furthermore, it is possible to take up the length of the cables only after the latter have reached a given elongation, and after the container has been put in a wrong position. Finally, the incidental torques overload the cables and the machine's elements by creating cambering and twisting forces within the frame.

In the second type of equipment, the orientation of the system is such that it hangs directly from the machine's frame. By correctly routing the cable on a number of lazy or idle pulleys, it is possible to keep the overall dimensions of the hanging system on the spreader within a rectangle whose length greatly exceeds the width, thus reducing the effects of the above disadvantages but without eliminating them. However, the cables follow the rotating motion of the container, which causes the cable system to become twisted, and it is not possible to obtain an orientation exceeding an angle of 90° on either side of a zero position.

SUMMARY OF THE INVENTION

The present invention aims at obtaining a container handling apparatus which offers the advantages of both popular types of equipment, while eliminating their disadvantages.

The container handling apparatus designed according to the specification of the invention includes four lifting cables, to the end of which the container orientation system is attached. This apparatus is characterized by the fact that the lower element of this rotating system includes two frames which respectively support a crown and four rollers. A four load receiver assembly is located between these frames, while four rollers are mounted so as to roll in a frame which is longitudinally attached to the container's support, following the longitudinal or long axis of the latter. It is therefore possible for the rotating device to move along the long axis with reference to the container. The longitudinal motions of this rotating device are automatically controlled by at least one cylinder or any other common device, such as a drive chain or a rack, driven by a reduction motor, based on the load measurements given by the receivers.

According to another specification of the invention, the four rollers and the four receivers define a quadrilateral whose center coincides with that of the quadrilateral defined by the four cables attaching points to the rotating device.

According to another specification of the invention, the apparatus is equipped with an electronic device which compares the load measurements given by the four receivers, and controls the activation of the various means which move the rotating device as long as the difference, between the various loads indicated by the receivers, exceeds an acceptable preset value.

According to another specification of the invention, the spreader attaches to the container's support with pins at one end, and with two cylinders or other popular remote devices at the other end, which allows the tilting of the container's support along the long axis of the spreader, in the case when this support has to be attached to a container resting on a slanted surface.

The container handling cranes are usually equipped with a gantry frame, an orientation crown, a rotating plate supporting the ballast weights, the mechanisms and a post, a plate, a boom pinned to the plate, as well as four lifting cables which are routed from a hoist and along the boom around lazy pulleys, before attaching to the container's orientation mechanism. This type of crane is characterized by the fact that it includes two lift drums which respectively wind up two cables that drop to the rotating device after being routed through four lazy pulleys. Each one of these lazy pulleys are approximately located on one angle of a square, one diagonal of which is parallel with the boom's axis as seen from the top, whereas the other diagonal is perpendicular to the axis of the boom. Two cables issued from a same drum are routed through two pulleys located on a same diagonal of the square.

According to another specification of the invention, the two pulleys which are mounted along the diagonal which is parallel with the boom's axis have an adjustable mount and can be mounted in alignment with the others. This mounting may be performed after displacing the two above mentioned pulleys and removal of the rotating device.

According to another specification of the invention, the lifting cables lazy pulleys are supported by a small boom which is jointed on one end of the boom and held in the back by a pull-rod which is parallel with the axis of the boom, so that this small boom, its span wire and the boom, define four sides of a parallelogram.

The container handling gantry designed according to the specifications of the invention, includes the following elements: two bearings supporting a beam defining the motion of a carrier, and four lifting cables originating in the carrier supported hoists and attached to the equipment so as to allow the orientation of the container. This gantry is characterized by the fact that it includes two lift drums whose respective axis are perpendicular, and respectively allowing the winding of two cables which drop to the rotation device, and whose section approximately defines a square or a diamond including one diagonal which is parallel to the beam's axis, and another one which is perpendicular to this long axis.

The attached, schematic drawings are intended to give a better understanding of the invention.

BRIEF DESCRIPTION OF THE DRAWINGS

FIG. 7 is a general view of a gantry built to the specifications of the invention.

FIG. 8 is a top view indicating the layout of the lift drums and cables of the gantry of FIG. 7.

DESCRIPTION OF THE PREFERRED EMBODIMENT

Figure 1:
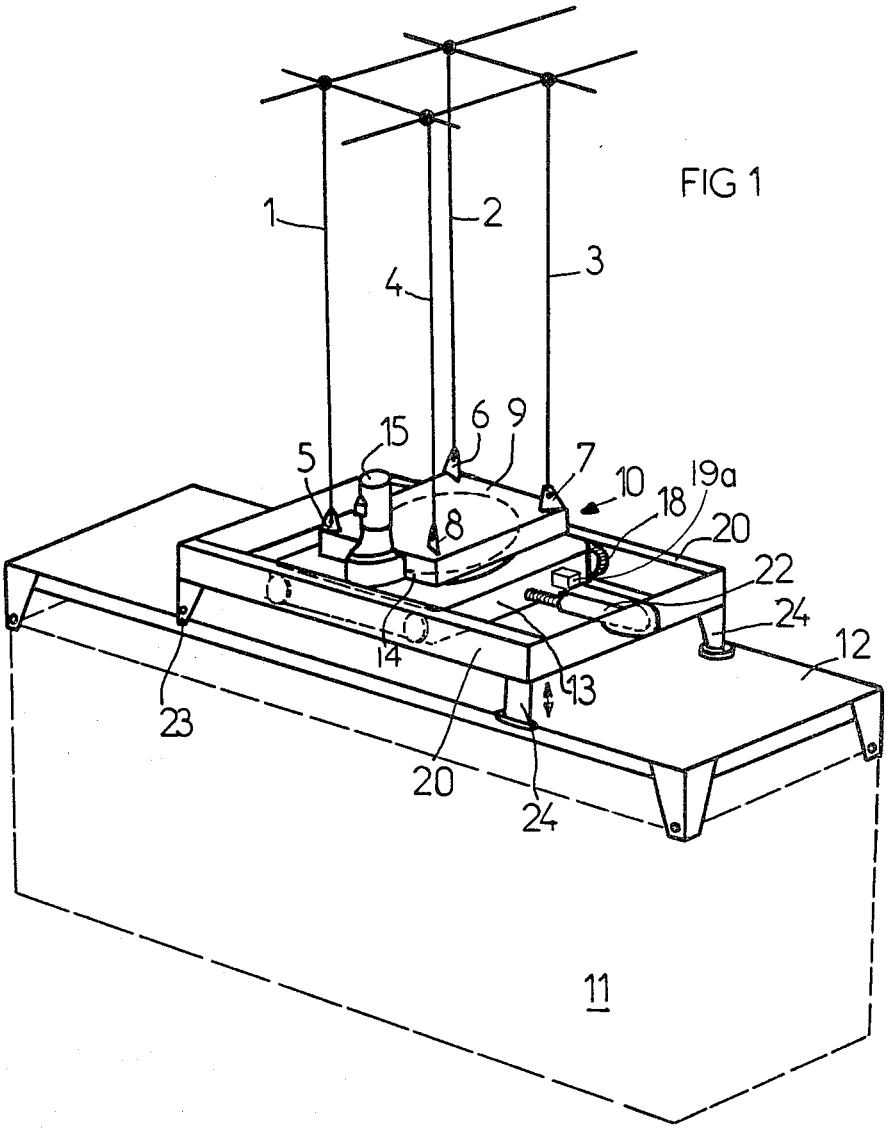
FIG. 1 is an elevation of the apparatus and of its orientating device.

FIG. 1 illustrates the container and its orientation device. The device includes four lifting cables 1, 2, 3, 4 each of which are respectively attached to one of four points 5, 6, 7 and 8 respectively of the fixed part 9 of a rotating device 10 which is provided to orientate the container 11. These four points are respectively located on the corners of a square whose diagonal is approximately equal to the width of the spreader 12. The rotating part 13, of the rotating device 10, which rotates with reference to the fixed part 9, is rigidly mounted with a toothed crown 14 meshed with a driving gear which is mounted in the reduction motor 15 of fixed part 9. These elements 14 and 15 are part of a remote control orientation mechanism.

Figure 2:
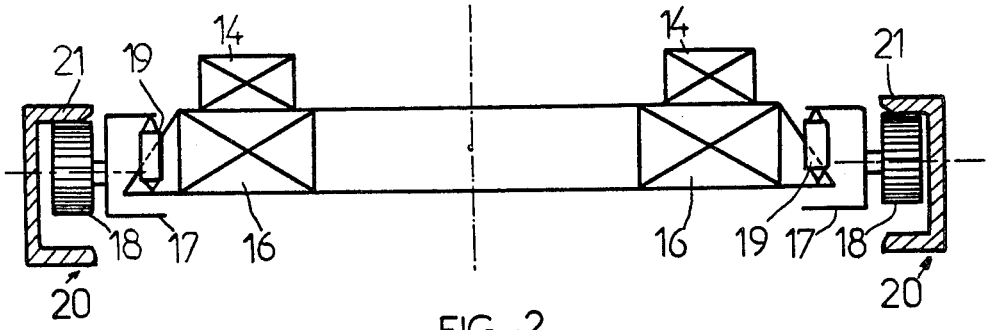
FIG. 2 illustrates a cross-section of this equipment's rotating apparatus, following a vertical plane which falls across the container.

The rotating part 13, illustrated on FIG. 2, includes a lower frame 16 supporting the toothed crown 14, and an external frame 17 supporting four parallel axis rollers 18. The external frame 17 is vertically supported by the internal frame 16, through four load receivers 19 which are located in the angles of the frames.

The center of the square defined by the four attachment points 5, 6, 7, 8 coincides approximately with the center of the square or rectangle defined by the four rollers 18.

Appropriate means, not represented, have been provided to guide the frames 16 and 17, and to retain the receivers 19 in the correct position.

A secondary frame 20 is attached on top of the spreader 12, and includes two side-rails 21 which are supported by the rollers 18. A reciprocating hydraulic cylinder 22, as shown in FIG. 1 extends parallel to the rails 21, or any other suitable control device, is attached between the secondary frame 20 and the external frame 17 of the rotating device 13.

An electronic device **19*a* includes all of the required measuring, comparing, amplifying, correcting and shock absorbing elements for good operation, allows an instant comparison between the measurements given by the four receivers 19 and issues a signal which activates the hydraulic cylinder 22, thus controlling the motion of the rotating assembly 10 with reference to the secondary frame 20 and to the container 11**, in parallel with the long axis of the container.

The apparatus operates as follows.

Usually, the center of gravity of the container 11 cannot be initially found on the vertical axis traced through the center of the square defined by the plane of the four attaching points 5, 6, 7 and 8, or the four load receivers 19.

Therefore, as soon as the cables are subjected to a tension effort, they are subjected to various loads and the loads measured by the receivers 19 are also different in value. The electronic device detects this difference and controls the hydraulic cylinder so as to cause a longitudinal motion of the rotating device 10 with reference to the container 11, in the appropriate direction. This motion stops as soon as the load difference between the receivers has reached an acceptable value. At this point, the container's center of gravity is located on the vertical axis going through the center of the square defined by cables 1 through 4, and during the lifting operation, the container's axis remains horizontal.

Since the container is stabilized prior to being moved, it never reaches an incorrect position such as a tilted position which could damage the goods that it contains and interfere with the handling operation. The container is stabilized at once regardless of the direction of the container's axis. The container is stabilized through the center of gravity of the container, thus no additional adjustment is required.

Considering this stability and the equal distribution of the loads among the four cables 1 through 4, the four cable portions limited by the frame of the crane and the rotating device 10 subject that frame to a vertical resulting load whose vector passes through the center of the square defined by the plane of the cable attaching points. The frame can then operate in the best conditions. Any incidental torques or loads are thus eliminated, since the resulting load is applied at the center of the plane of the cable system.

Furthermore, the frame 20 is attached to the spreader 12 by means of pins 23 at the one end, and by two cylinders 24, or any other suitable known remote device, at the other end. By maneuvering these devices 24, the spreader 12 may be tilted with reference to the spreader 20, so as to lower and attach it to the container 11 as where the container is resting on a slanted surface.

In conclusion, the advantages are the following:

Even though the square defined by the plane of the cable attaching points onto the fixed element 9 of the rotating device 10 is relatively small, the container 11 can be easily and perfectly stabilized.

The balance is obtained before the container is lifted, and before it reaches an incorrect tilted position.

The cables are not affected by the container's rotation, and the rotating angle of the container is not limited.

The load is equally distributed among the cables, and there is no incidental effort, such as those created by a cambering or a twisting of the frame. The resulting load applied following the lifting of the container is perfectly centered and symmetrical. A greater operational reliability is thus obtained, without having to increase the dimensions of the elements.

With a remote device 24, the container support may be correctly directed so as to attach it to a container resting on a slanted surface.

Figure 3:
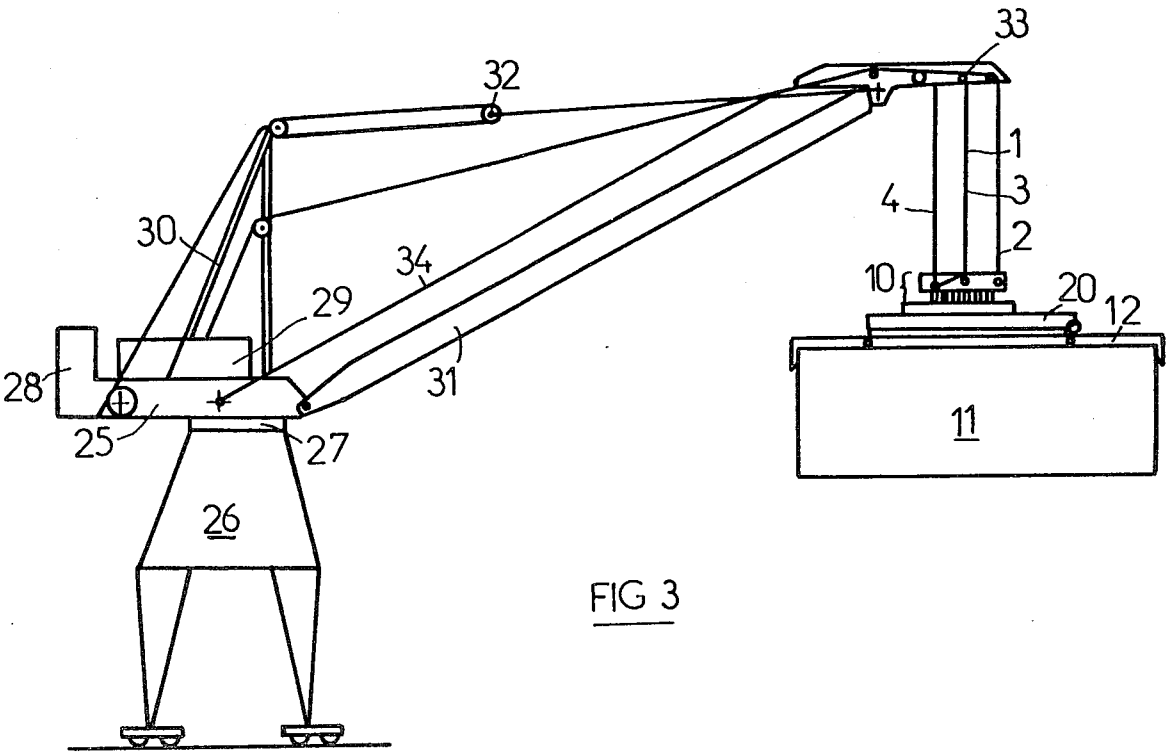
FIG. 3 is a general side view of a crane built to the specifications of the invention.

FIG. 3 illustrates a crane equipped with a handling apparatus built to the specifications of the invention. This crane includes a rotating plate 25 which is mounted on a gantry frame 26, using an orientation crown 27. The plate 25 supports a ballast 28, the mechanisms 29 and a post 30. The boom 31 which is jointed a horizontal pivot of plate 25, may be raised using a reeving 32. The free end of boom 31 includes a horizontal pivot on which is mounted a smaller boom 33. This pivot is connected at the median part of the small boom, and a wire 34 connects the rear part of the small boom 33 with a fixed point in the plate 25. The attaching points of wire 34 are carefully selected, so that the small boom 33, the boom 31, the wire 34 and a line connecting the wire 34 attaching point with the horizontal pivot associated with boom 31, on the plate 25, define the four sides of a pivoted parallelogram.

The main purpose of the small boom 33 is to support the lazy or idler pulleys of the four lifting cables 1, 2, 3 and 4.

Figure 4:
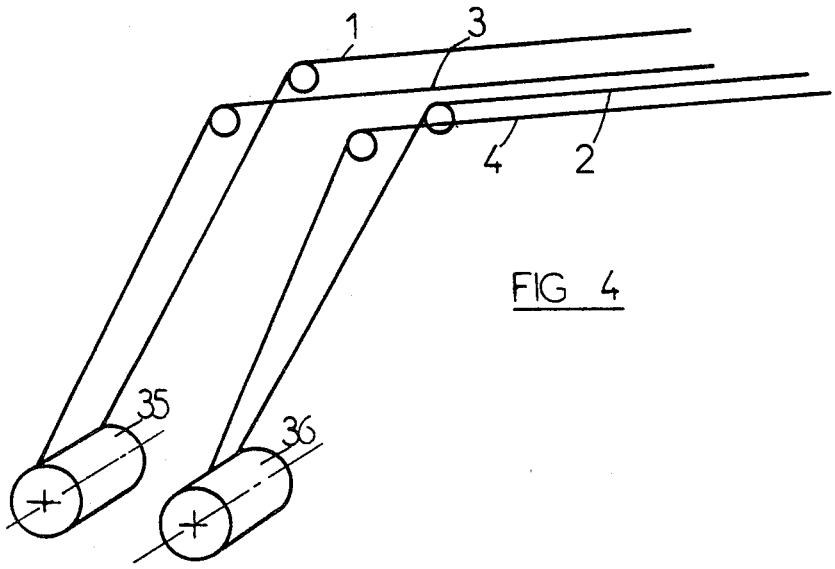
FIG. 4 is a schematic, elevation view showing part of the routing of the cables along the crane.
Figure 5:
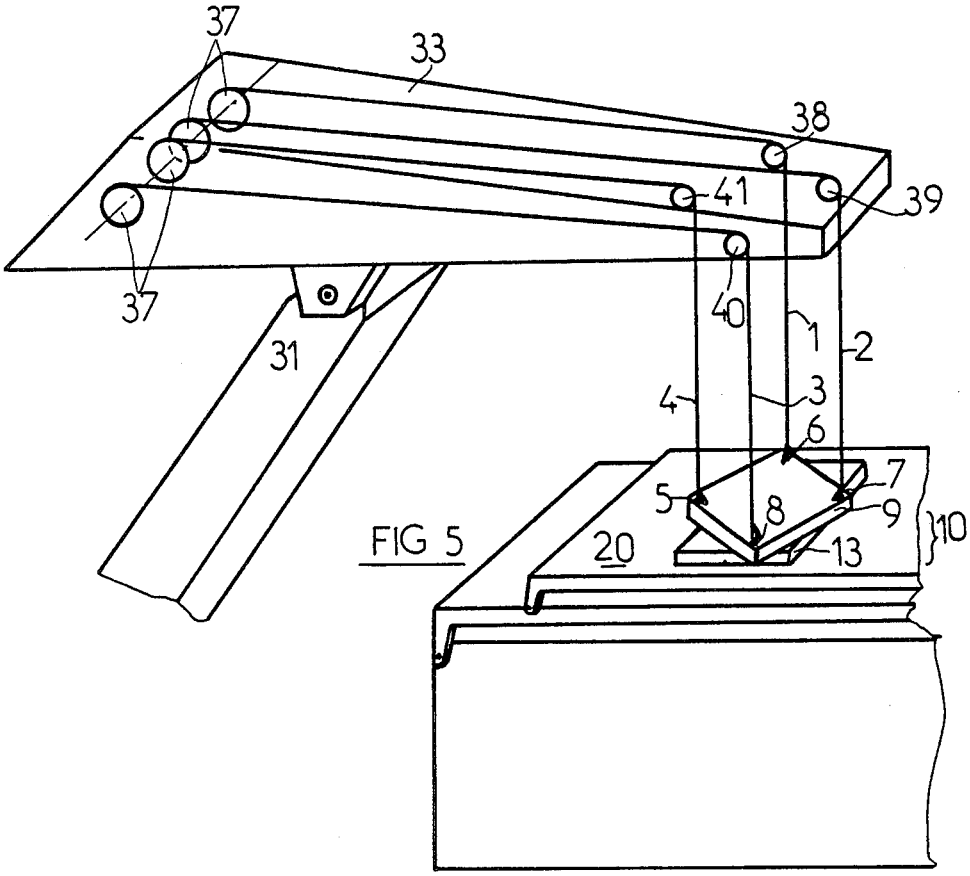
FIG. 5 is a schematic elevation view showing the routing of the cables along the small boom of the crane.

The plate 25 includes two lifting hoists respectively equipped with drums 35 and 36 as shown in FIG. 4. Cables 1 and 3 unwind from drum 35, whereas cables 2 and 4 unwind from drum 36. The cables 1, 2, 3 then pass through the lazy or idler pulleys 37 (FIG. 5) which are located on the small boom 33. Thereafter, the cables 1, 2, 3, and 4 are respectively routed through pulleys 38, 39, 40 and 41, before dropping to their respective attaching points on the rotating device 10. The axes of the four pulleys 38 thru 41 are parallel and approximately contained in a single plane. Pulleys 38 and 40 are coaxial and the position of the axes of pulleys 41 and 39 is adjustable. Therefore, the axes of pulleys 39 and 41 are normally kept on either side of the axis which is common to pulleys 38 and 40, but pulleys 39 and 41 may be also moved so as to be coaxial with pulleys 38 and 40 as indicated by the dotted line in FIG. 6. The switch from one position to another is only possible when the cables are unloaded.

Figure 6:
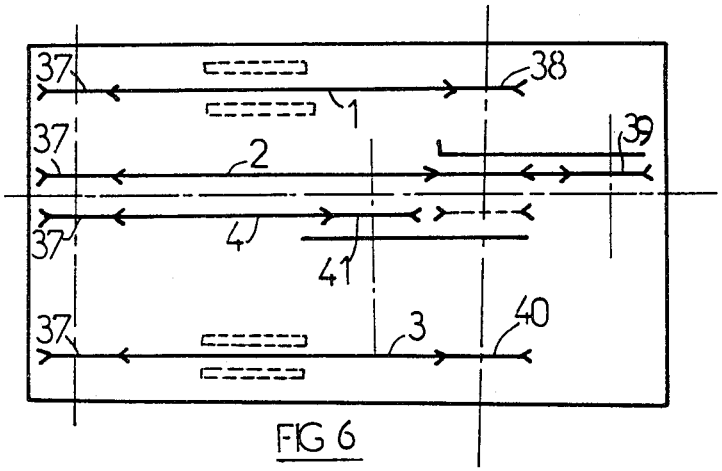
FIG. 6 is a plane view of the small boom of the crane.

At the level of the small boom, and as the pulleys are in their normal position, as shown in the continuous lines in FIG. 6, the four cables, 1 through 4, as seen from the top, are respectively positioned on one of the four corners of a square whose diagonals have a length which is appoximately equal to the width of spreader 12. One of these diagonals is parallel to the boom's axis, whereas the other is perpendicular to the boom's axis when seen from the top. It is therefore understood that the larger the square, the greater the assembly stability during the orientation or displacement operations.

The jointing of the small boom 33 to boom 31 offers a double advantage. First, the boom 31 is subjected to a simple compression only, as the load is lifted, and it still operates in good conditions. Second, thanks to the pivoted parallelogram mounting obtained with the pull-rod or wire 34, the small boom 33 always remains parallel to the plane defined by the axis of pulleys 38 through 41 as the boom's tilt varies, so that the rotating axis of the rotating part 13 of the rotating device 10 always remains vertical.

Even though it is not possible to move the rotating device 10 along the width of the container, in order to compensate a lateral displacement of the center of gravity of the container, it is obvious that such an offsetting is automatically compensated by the mechanism, considering the layout of the four cables. Assuming, for instance, that the center of gravity of the container is located on the same side as cables 2 and 3 on FIG. 1, both cables would then be overloaded, whereas the two other cables 1 and 4 are discharged of a quantity equal to the overload of cables 2 and 3. However, since both of the overloaded cables 2 and 3 are anchored on two different drums which are respectively drums 36 and 35, the load applied to both drums is identical and its value is the one that it would have if the center of gravity were perfectly centered on the width of the container. Therefore, the torque and the rotational speeds of both drums always remain the same.

The crane may easily be modified for use in another application.

After lowering onto the ground the device used for the orientation of the container, the cables may be unfastened at points 5 through 8 so as to allow the mounting of a rotating crossbar as a replacement for the above discussed prehensile apparatus. The new assembly does not affect the relative spacing of the cables.

By mounting pulleys 38 through 41 in line, after displacing pulleys 39 and 41 toward the middle, as indicated by the dotted line on FIG. 6, it is possible to use the device with a two-cable bucket, using the two cables of drum 35 to control the opening of the bucket, and the two cables of drum 36 to close the bucket.

It is also possible to mount a cross-bar equipped with a hook with the device.

In conclusion, the crane thus equipped offers the following advantages, in addition to those offered by the container orientation device.

The vertical axis of the orientation device 10 remains in its initial position, regardless of the boom's orientation.

In case of transverse displacement of the center of gravity of the container, the torque and the rotational speed of both drums remains identical to the value that they would have if the container was perfectly balanced. An overdimensioning of the lifting hoists is thus avoided.

The crane remains a multi-purpose one since its equipment may easily be modified to include a rotating cross-bar, a two-cable bucket or an ordinary lifting cross-bar.

FIG. 7 illustrates a gantry crane equipped with an apparatus built to the specifications of the invention. This gantry includes two posts 42 holding a beam along which a carrier 44 may roll.

This carrier includes two drums 45 and 46 which are perpendicular one to another. Cables 1 and 3 unwind from drum 45, and cables 2 and 4 unwind from drum 46, each one of the cables being able to wind up on an appropriately located and dimensioned zone located at one end of the drum.

When the container 11 is in the raised position, cables 1 through 4 are positioned as indicated at *1h*, *2h*, *3h*, *4h* in FIG. 8. The length of the diagonals of the square or of the diamond defined by the four points 1*h* through 4*h* is equal or exceeds the width of spreader 12 for the container 11.

Furthermore, the winding direction is such that, as the container is lowered, the cable spacing increases and the cables come to the positions indicated as 1*b*, 2*b*, 3*b*, 4*b* on FIG. 8, in such a way that the diagonals of the square, or of the diamond defined by the four points 1*b* through 4*b* exceed in length the diagonals of the quadrilateral defined by the four points 1*h* through 4*h*.

Such a system is therefore comparable to the system previously designed for the crane, the four cables defining from their initial start from the drums, a quadrilateral including a diagonal which is parallel to the long axis of beam 43 of the gantry, and another diagonal which is perpendicular to this axis.

Moreover, this system tends to reinforce the stability during the orientation manoeuvers, as the container is lowered, by increasing the twist rigidity of the four cable assembly, as well as during the back and forth motion operations.

This additional advantage should be added to those offered by the container's orientation device, beside the fact that in the case of a transverse off-setting of the center of gravity of the container, the torque and rotation speed of both drums remain identical to the values that they would have if the container were perfectly balanced.

I claim:

1. A container handling apparatus for use with an overhead material handling device having four lifting cables, said apparatus comprising:

a four sided fixed part pendantly connected at each corner to each of said lifting cables, said four sided fixed part defining a first plane at the connection of said four lifting cables to said four sided fixed part, said first plane having a center;

a rotating member rotatably mounted below said fixed part for relative rotational movement therewith; said rotating member further comprising:

a lower frame member;

an external frame member mounted adjacent to the periphery of said lower frame member;

a secondary four sided frame member mounted adjacent to the periphery of said external frame member, said secondary four sided frame member having two parallel side rails;

four parallel rotatable members rotatably mounted to the periphery of said external frame, said four parallel rotatable members having a first pair of rotatable members, a second pair of rotatable members and a second plane defined by said four rotatable members, said second plane having a center, said first pair of said four rotatable members further engaging one of said two parallel side rails and said second pair of said four rotatable members further engaging the other of said two parallel side rails, each of said four rotatable members further being mounted to said external frame member so that said center of said second plane defined by said four rotatable members coincides with said center of said first plane defined by the connection of the four cables to said four sided fixed part;

a spreader member pendantly connected to said secondary four sided frame, said spreader member further demountably secured to said container for handling of said container;

moving means, mounted at one end to said secondary four sided frame member and mounted at the other end to said external frame member, for moving said secondary four sided frame member longitudinally relative to said external frame member so that the center of gravity of the weight of the container is located on a vertical axis through said center of said second plane defined by said four rotatable members;

load measuring means, mounted between said lower frame member and said external frame member, for measuring the load in each of said four lifting cables so as to generate a signal having a characteristic indicative of the load in each of said four cables; and comparison means for receiving each of said signals from each of said four cables of said load measuring means to operate said moving means whenever one of said each of said signals from said measuring means exceeds a predetermined value so that said moving means moves said secondary frame member to equally distribute the load in each of said four cables.

2. A container handling apparatus as claimed in claim 1 wherein said four sided fixed part, said lower frame member, and said external frame are square shaped.

3. A container handling device as claimed in claim 2 wherein said spreader member and said secondary four sided frame member are rectangular shaped; and wherein said spreader member is pivotably secured at one end to said secondary four sided frame member by a pair of pins and at the other end by a pair of movable cylinder members in order to tilt the plane of said spreader member with respect to the longitudinal plane of said secondary four sided frame member when the container is resting on a slanted surface.

4. A container handling apparatus as claimed in claim 1 wherein said lower frame member and said external frame member are rectangular shaped.

5. A container handling apparatus as claimed in claim 1 wherein said four sided fixed part is square shaped and said spreader member is rectangular shaped; and wherein the diagonal of the plane defined by the square shaped four sided fixed part is equal to the width of the rectangular shaped spreader member.

6. A container handling device as claimed in claim 1 further comprising:

a toothed crown member mounted on said rotating member, said tooth crown rotatably mounted to said four sided fixed part for relative motion therewith; and a driving gear mounted on said four sided fixed part and drivably engaged to said toothed crown member in order to rotate said rotating member relative to said four sided fixed part.

7. In a container handling crane with four parallel cables, said crane further having a rotating plate mounted on a gantry frame, a ballast member mounted on said rotating plate, two lifting drums mounted on said rotating plate, and a boom pivotably mounted at one end to said rotating plate, wherein the improvement comprises:

a smaller boom mounted to the other end of said boom with said four cables suspended from said smaller boom;

a four sided fixed part pendantly connected at each corner to each of said four cables, said four sided fixed part defining a first four sided plane at the connection of said four cables, said first four sided plane having a center;

a rotating member rotatably mounted below said fixed part for relative rotational movement therewith, said rotating member further comprising:

a lower frame member;

an external frame member mounted adjacent to the periphery of said lower frame member;

a secondary four sided frame member mounted adjacent to the periphery of said external frame member, said secondary four sided frame member having two parallel side rails;

four parallel rotatable members rotatably mounted to the periphery of said external frame, said four parallel rotatable members having a first pair of rotatable members, a second pair of rotatable members and a second plane defined by said four rotatable members, said second plane having a center, first pair of said rotatable members further engaging one of said two parallel side rails and said second pair of said rotatable members further engaging the other of said two parallel side rails, each said four rotatable members further being mounted to said external frame member so that said center of said second plane defined by said four rotatable members coincides to the center of the plane defined by the connection of the four cables to said four sided fixed part;

a spreader member pendantly connected to said secondary four sided frame, said spreader member further demountably secured to said container for handling of said container;

moving means, mounted to one end to said secondary four sided frame member and mounted at the other end to said external frame member, for moving said secondary four sided frame member longitudinally relative to said external frame member so that the center of gravity of the weight of the container is located on a vertical axis through said center of said second plane defined by said four rotatable members;

load measuring means, mounted between said lower frame member and said external frame member, for measuring the load in each of said four lifting cables so as to generate a signal having a characteristic indicative of the load in each of said four cables; and comparison means for receiving each of said signals from each of said four lifting cables of said load measuring means to operate said moving means whenever one of said each of said signals from said measuring means exceeds a predetermined value so that said moving means moves said secondary frame member to equally distribute the load in each of said four cables.

8. In a container handling crane as described in claim 7, further comprising:

a wire connecting said smaller boom and said rotating plate, said wire further being connected to said smaller boom and said rotating plate and in spaced relationship to said boom, smaller boom and said plate so as to define the four sides of a parallelogram; and wherein the first and second of said four cables are wound around said first drum and said third and fourth of said four cables are wound around said second drums.

9. In a container handling crane as described in claim 8, further comprising:

four pulleys mounted in parallel on said smaller boom, the first and fourth of said pulleys are fixed with respect to said smaller boom, the second and third of said pulley are slidably mounted with respect to said smaller boom so as to permit adjustment of said second and third of said pulleys with respect to each other and with respect to said first and fourth pulleys; wherein the first and said four cables is suspended from said first of said four pulleys, the second of said four cables is suspended from said second of said four pulleys, the third of said four cables is suspended from said third of said four pulleys and the fourth of said four cables is suspended from said fourth of said four pulleys; and wherein the first cable is attached to the first corner of said four sided fixed part, the second cable is attached to the second corner of said four sided fixed part, the third cable is attached to the third corner of said four sided fixed part and the fourth cable is attached to the fourth corner of said four sided fixed part.

10. In a container handling crane as claimed in claim 9 wherein said four sided fixed part, said lower frame member, and said external frame member are square shaped.

11. In a container handling crane as claimed in claim 9 wherein said lower frame member and said external frame member are rectangular shaped.

12. In a container handling crane as claimed in claim 9 wherein said four sided fixed part is square shaped and said spreader member is rectangular shaped;

wherein the diagonal of the plane defined by the square shaped four sided fixed part is equal to the width of the rectangular shaped spreader member.

13. In a gantry crane using four lifting cables for lifting containers, said gantry crane having a beam held at each end by at least one of two vertical posts, and a carrier which moves along said beam from one post to the other post, wherein the improvement comprises:

two drums mounted in said carrier, one of said drums mounted perpendicular to the other of said drums;

the first and third of said four cables further being wound around one of said drums so that the first and third cables are suspended from said one drum in spaced apart relationship and the second and fourth of said four cables further being wound around the other of said drums so that the second and fourth of said four cables are suspended from said other drum in spaced apart relationship;

a four sided fixed part pendantly connected at each corner to each of said lifting cables, said four sided fixed part defining a first plane at the connection of said four lifting cables to said four sided fixed part, said first plane having a center;

a rotating member rotatably mounted below said four sided fixed part for relative rotational movement therewith, said rotating member further comprising:

a lower frame member;

an external frame member mounted adjacent to the periphery of said lower frame member;

a secondary four sided frame member mounted adjacent to the periphery of said external frame member, said secondary four sided frame member having two parallel side rails;

four parallel rotatable members rotatably mounted to the periphery of said external frame member, said four parallel rotatable members having a first pair of rotatable members, a second pair of rotatable members and a second lane defined by said four rotatable members, said second plane having a center; said first pair of said four rotatable members further engaging one of said two parallel side rails and said second pair of said four rotatable members further engaging the other of said two parallel side rails, each of said four rotatable members further being mounted to said external frame member so that said center of said second plane defined by said four rotatable members coincides with said center of said first plane defined by the connection of the four cables to said four sided fixed part;

a spreader member pendantly connected to said secondary four sided frame, said spreader member further demountably secured to said containers for handling of said container;

moving means mounted at one end to said secondary four sided frame member and mounted to the other end to said external frame member, for moving said secondary four sided frame member longitudinally relative to said external frame member so that the center of gravity of the weight of the container is located on a vertical axis through said center of said second plane defined by said four rotatable members;

load measuring means, mounted between said lower frame member and said external frame member, for measuring the load in each of said four lifting cables so as to generate a signal having a characteristic indicative of the load in each of said four cables; and comparison means for receiving each of said signals from each of said four cables of said load measuring means to operate said moving means whenever one of said each of said signals from said measuring means exceeds a predetermined value so that said moving means moves said secondary frame member to equally distribute the load in each of said four cables.

14. In a gantry crane device as claimed in claim 13 wherein said spreader member and said seconary frame member are rectangular shaped; and wherein said spreader member is pivotably secured at one end to said secondary frame by a pair of pins and at the other end by a pair of movable cylinder members in order to tilt the plane of said spreader member with respect to the longitudinal plane of said secondary frame member when the container is resting on a slanted surface.

15. In a gantry crane device as claimed in claim 14 further comprising:

a toothed crown member mounted on said rotating member, said tooth crown rotatably mounted to said fixed part for relative motion therewith; and a driving gear mounted on said fixed part and drivably engaged to said toothed crown member in order to rotate said rotating member relative to said fixed part.

* * * * *

UNITED STATES PATENT AND TRADEMARK OFFICE

CERTIFICATE OF CORRECTION

PATENT NO. : 4,350,254

DATED : September 21, 1982

INVENTOR(S) : Jean Noly

It is certified that error appears in the above-identified patent and that said Letters Patent is hereby corrected as shown below:

Column 1, Line 60: Delete "idle" and insert --- idler ---

Column 3, Line 23: Delete "elevation" and insert --- elevational view ---

Column 3, Line 60: Delete ","

Column 4, Line 4: Delete ","

Column 4, Line 40: Delete "operation" and insert --- operations ---

Column 4, Line 59: Delete "spreader" and insert --- frame ---

Column 5, Line 37: After "3" insert --- and 4 ---

Column 7, Line 18: Delete "manoeuvers" and insert --- maneuvers ---

Column 9, Line 19: After "," insert --- said ---

UNITED STATES PATENT AND TRADEMARK OFFICE

CERTIFICATE OF CORRECTION

PATENT NO. : 4,350,254

DATED : September 21, 1982

INVENTOR(S) : Jean Noly

It is certified that error appears in the above-identified patent and that said Letters Patent is hereby corrected as shown below:

Column 10, Line 6: Delete "pulley" and insert --- pulleys ---

Column 10, Line 10: Delete "and" (2nd. occurr.) and insert---of---

Column 10, Line 34: After ";" insert --- and ---

Column 11, Line 5: Delete "lane" and insert --- plane ---

Signed and Sealed this

Eighth Day of March 1983

[SEAL]

Attest:

GERALD J. MOSSINGHOFF

Attesting Officer

Commissioner of Patents and Trademarks